US005219141A

United States Patent [19]

Pecor

[11] Patent Number: 5,219,141

[45] Date of Patent: Jun. 15, 1993

[54] OFFSET BRACKET

[76] Inventor: Raymond J. Pecor, 13558 Erin Dr., Lockport, Ill. 60441

[21] Appl. No.: 692,623

[22] Filed: Apr. 29, 1991

[51] Int. Cl.[5] ..... A47G 29/00

[52] U.S. Cl. ..... 248/328; 248/303; 248/340

[58] Field of Search ..... 248/301, 302, 304, 303, 248/317, 340, 339, 328, 243; 47/67

[56] References Cited

U.S. PATENT DOCUMENTS

| | | | |
|---|---|---|---|
| 187,380 | 2/1877 | Henry | 248/328 |
| 354,962 | 12/1886 | Yale | 248/328 |
| 2,157,400 | 5/1939 | Cooper | 211/129 X |
| 3,824,959 | 7/1974 | Naig | 248/302 X |
| 3,967,578 | 7/1976 | Gallo | 47/67 X |
| 4,074,882 | 2/1978 | Anderson | 47/67 X |
| 4,078,753 | 3/1978 | Cole | 248/302 X |
| 4,463,855 | 8/1984 | Smithers | 47/67 X |

*Primary Examiner*—Karen J. Chotkowski
*Attorney, Agent, or Firm*—Augustus G. Douvas

[57] ABSTRACT

An offset bracket carried on a fulcrum ring or hook for adjustably positioning a hanging item, such as a lighting fixture or a planter, in relation to a ceiling or other overhead point. The bracket comprises an elongated fulcrum shaft pivotally engaging the fulcrum ring or hook. A hook is fixed to one end of the fulcrum shaft to carry the hanging item, and an adjustable bifurcated leg support is fixed to the other end of the fulcrum shaft. The leg support rests against the ceiling or an overhead support surface. Radial and angular adjustment of the fulcrum shaft on the fulcrum ring or hook provides offset positioning of the hanging item relative the ceiling or other attachment point.

2 Claims, 1 Drawing Sheet

OFFSET BRACKET

This invention relates to an offset bracket whose purpose is to relocate, or swag, lighting fixtures, potted plants and bric-a-brac of various kinds that hang from a ceiling or other overhead support surface.

BACKGROUND RELATING TO THE INVENTION

The present invention relates to bracket-type hardware for hanging lamps, plants and bric-a-brac requiring a plumb-line position not located below the point of mechanical attachment to a ceiling or other overhead surface. In the past additional hooks have been attached to ceilings in order to change the plumb-line locations of swagging fixtures, such as handing chandeliers, relative their point of initial permanent attachment. In other instances, existing support hooks have been relocated in order to reposition hanging items to new locations with the result that unsightly holes or other disfigurement appears at the original locations.

Some ceiling material, such as concrete, is not conducive to installing or relocating hooks.

SUMMARY OF THE INVENTION

Accordingly, it is a principal object of the present invention to provide an inexpensive simply-installed bracket which can be applied to existing mechanical devices for supporting hanging items to effect an adjustable relocation of these items.

Another object of the present invention is to effect an adjustable relocation of hanging items relative their connection points to ceilings or other overhead surfaces by providing a simply-installed, inexpensive offset bracket that uses the existing ceiling or other surface attachments.

Another object is to provide an offset bracket for hanging items that is both aesthetic and simple in design and which will effect both angular and radial offset relocation of the hanging items relative their existing ceiling or other surface attachments.

The offset bracket of this invention comprises a main shaft having a manually adjustable bearing location on the existing structure used to support a hanging item on a ceiling or other overhead surface. This bearing location is generally located in a mid-section of the shaft body with both ends of the shaft projecting beyond the support structure. An integral hook is fixed to one end of the shaft and an adjustable-length bifurcated leg support is fixed to the other end of the shaft. When a hanging item is attached to the bracket hook the leg support rests against the ceiling or other overhead support surface to fix the plumb-line location of the hanging item. The main shaft can be moved both angularly and radially relative the bearing structure supporting the main shaft to position the hanging item to a desired offsetting location.

The offset bracket of this invention can be used for such varied purposes as centering a lighting fixture on a table or moving an overgrown potted hanging plant away from a crowded position in relative to a wall or a corner of a room.

DESCRIPTION OF THE DRAWINGS

In order that all of the structural features for attaining the objects of this invention may be readily understood, reference is made to the following drawings in which.

DESCRIPTION OF THE INVENTION

Figure 1:
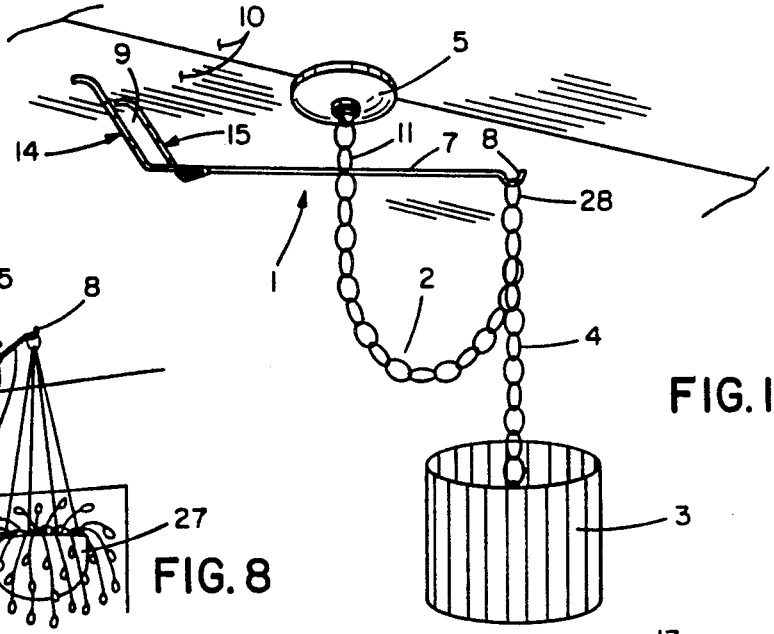
FIG. 1 is a view showing a preferred embodiment of the offset bracket of this invention applied to a chain-supported, ceiling-mounted lighting fixture to provide offset (or swag) of a lighting unit.

FIG. 1 of the drawings shows the application of offset bracket 1 of this invention to effect an aesthetic swag 2 in a hanging light fixture 3 carried on the lower end of chain 4. The upper end of chain 4 is fixed to a conventional ceiling-mounted canopy cover 5 for an electrical box (not shown).

Chain-hanging lighting fixtures are positioned by gravity directly below the point of attachment along an extended plumb line. The point of attachment is usually dictated by the location of a ceiling-mounted electrical box. The resulting disposition of a particular lighting fixture may not be satisfactory. This plumb line location may be altered or relocated by inserting a swag in the chain. A hook bracket fixed to the ceiling with an appropriate offset from the electrical box can effect the required swag; however, in an installation in which the ceiling is made of concrete, or a varied position of a hanging lighting fixture is desired, a hook fixed to the ceiling may be difficult to secure or move.

Offset bracket 1 eliminates both of these disadvantages by enabling easy relocation of the plumb line of a hanging item relative to its point of original mechanical attachment to a ceiling or other surface. In particular, the position of a chain-supported lighting fixture may be adjusted to any angle in a 360° range measured from the original point of mechanical attachment to the ceiling and also moved radially so as to change the location of the fixture plumb line.

Accordingly, a hanging lighting fixture may be centered over a table even though the canopy cover for the electrical box is off center. Similarly, if the table is expanded in one direction the lighting fixture may be recentered over the enlarged table without moving the canopy cover or installing a ceiling hook.

Figure 8:
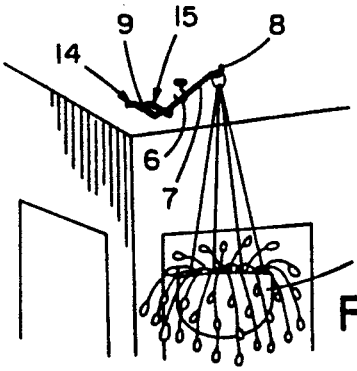
FIG. 8 is a view of the offset bracket supporting a hanging planter basket.
Figure 2:
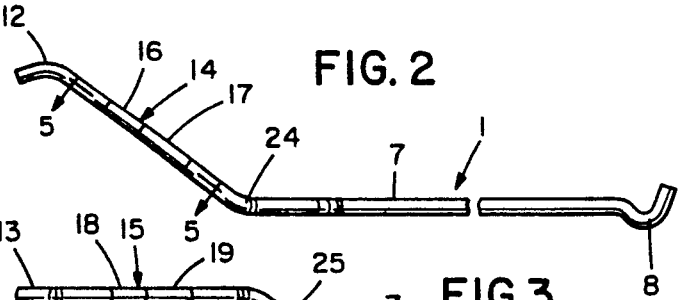
FIG. 2 is a front elevation view of the offset bracket of FIG. 1.
Figure 4:
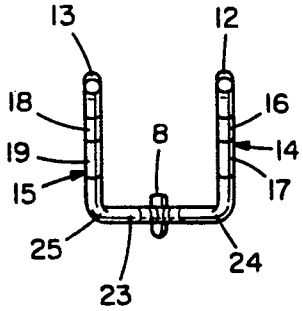
FIG. 4 is a left elevation view of the offset bracket.

Another example where offset bracket 1 may be used to advantage relates to a corner hanging plant (FIG. 8) that has out-grown its point of attachment, usually a ceiling hook. The plumb line of the plant may be readily moved away from the corner by engaging offset bracket 1 to a corner hook 6.

A preferred and decorative embodiment of offset bracket 1 comprises an elongated fulcrum shaft 7 which is a relatively long and slender straight metal rod (FIGS. 1-3, 6-8). A metal fixture hook 8 is integrally fixed to one end of fulcrum shaft 7 and a metal bifurcated leg support 9 is also integrally fixed to the opposite end of fulcrum shaft 7.

When properly installed on a horizontal ceiling 10, fulcrum shaft 7 passes through a particular chain link or ring 11 (FIGS. 1–6) selected so that fulcrum shaft 7 is aligned parallel to ceiling 10.

Ring 11 is appropriately termed a fulcrum ring because it serves as a "part time" fulcrum for fulcrum shaft 7. That is, shaft 7 initially pivots on ring 11 until curved metal feet 12 and 13 contact and rest against ceiling 10. Metal leg 14 carries foot 12 and metal leg 15 carries foot 13. The weight of lighting fixture 3 in the installation of FIG. 1 pivots feet 12 and 13 on fulcrum ring 11 into touching contact with ceiling 10. The friction and other forces generated by this contact hold lighting fixture in place.

The radial position of fixture 3 relative canopy cover 5 can be changed by manually sliding fulcrum shaft 7 on its longitudinal axis relative fulcrum ring 11; and the angular position of fixture 3 relative canopy cover 5 can be changed by manually rotating fulcrum shaft 7 relative fulcrum ring 11. The height of fixture 3 is changed by altering swag 2 by appropriately selecting the ring, such as ring 28 (FIG. 1) which engages fixture hook 8.

Figure 5:
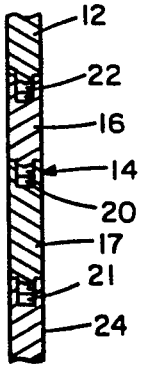
FIG. 5 is a section view taken along line 5—5 of FIG. 2 which shows a set of leg adjustment links used in the preferred embodiment of the offset bracket.
Figure 6:
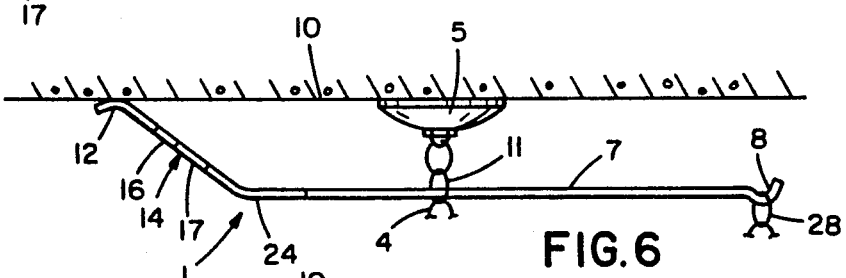
FIG. 6 is a front elevation view which shows the preferred parallel alignment of the fulcrum shaft of the offset bracket with the supporting ceiling surface.

In the preferred embodiment of offset bracket 1 shown in the drawings, legs 14 and 15 each include a pair of removable leg-length adjustment links (FIG. 5). When legs 14 and 15 are at their maximum length, two links 16 and 17 are inserted in as part of leg 14 and two links 18 and 19 are inserted in as part of leg 15. All of the links 16, 17, 18 and 19 are identical in size and construction.

Figure 3:
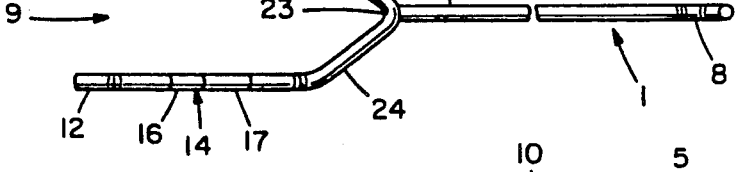
FIG. 3 is a plan view of the offset bracket.

Each link is formed with a circular threaded hole at one end and projecting threaded stud, such as 20 and 21 (FIG. 5) at the other end. Each foot 12 and 13 is also formed with a threaded stud, such as stud 22 of foot 12 (FIG. 5). Legs 14 and 15 are joined to fulcrum shaft 11 by curved v-shaped leg connector 23 fabricated of metal (FIG. 3). Each arm 24 and 25 of leg connector 23 is formed with a threaded hole which receives and engages a threaded stud, such as threaded stud 21 of link 17 (FIG. 5). The threaded studs, such as and 22 engage their mating holes to form a rigid, bifurcated leg support 9 fixed to fulcrum shaft 7.

Figure 7:
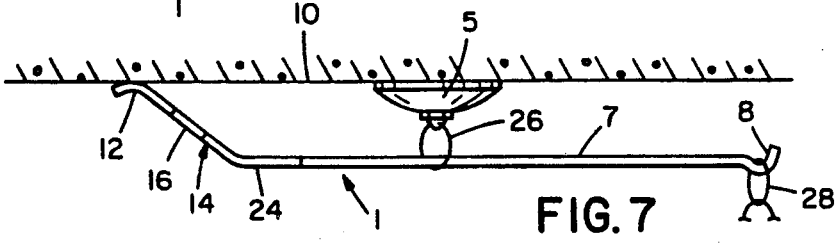
FIG. 7 is a front elevation view, corresponding generally to FIG. 6, with one of the leg-adjustment links removed to maintain the desired parallel alignment of the fulcrum shaft with the ceiling in response to a change in the distance of the fulcrum from the surface of the ceiling.

Leg length adjustment links 16, 17, 18 and 19 are an optional but desirable feature of offset bracket 1. Canopy covers and chain links come in various sizes and shapes. Accordingly, a desirable parallel disposition of fulcrum shaft 7 relative ceiling 10 cannot be attained with all these different sizes. By adding or removing one or more leg-adjustment links to each leg 14 and 15, a parallel relationship can be attained exactly or closely. In FIG. 7, fulcrum shaft 7 engages the first chain ring or link 26 attached to canopy cover 5. Ring 26 is larger than the links employed in the chain of FIG. 6; therefore in FIG. 6 only one leg-length adjusting link is employed as part of each leg 14 and 15 to effect the desired parallel relationship.

Offset bracket 1 can also be used to position items not supported on chains. For example, in FIG. 8, a hanging planter 27 engages hook 8. A ceiling hook 6 serves as a fulcrum support for fulcrum shaft 7. Angular positioning adjustments for planter 27 can be effected by turning hook 7 relative ceiling 10, and radial positioning adjustments can be effected by sliding fulcrum shaft 7 on hook 6.

Variations and modifications can be made in the preferred embodiment shown in the drawings and described in this specification without departing from the scope of the invention.

What is claimed is:

1. The combination for adjustably positioning a chain-supported hanging item in relation to a ceiling; comprising a chain having a plurality of chain rings with one of the rings serving as a ceiling-mounted fulcrum support; and an offset bracket including a rodlike elongated body coupled at a mid-body portion to the fulcrum support by insertion through one chain ring, means coupled generally at a first end portion of the elongated body and adapted to carry the hanging item, leg means coupled to a second end portion of the body located generally at an opposite end of the elongated body removed from the first end portion with the leg means including a set of bifurcated legs with each leg having an extremity contacting the ceiling at a locus spaced from the other extremity to stabilize the offset bracket and fix the position of the offset bracket relative to the ceiling, and in which a second chain ring engages the means coupled to the first end portion of the elongated body to effect a swag in the chain.

2. The combination for adjustably positioning a hanging item in relation to a ceiling comprising a ceiling-mounted fulcrum support; and an offset bracket including an elongated rodlike body coupled at mid-body portion to the fulcrum support, means coupled generally at a first end portion of the elongated body and adapted to carry the hanging item, leg means including a set of bifurcated legs coupled to a second end portion of the body located generally at an opposite end of the elongated body removed from the first end portion with each leg having an extremity contacting the ceiling at a locus spaced from the other extremity to stabilize the offset bracket and fix the position of the offset bracket relative to the ceiling, and with each leg to enable the offset bracket to be lowered relative the ceiling and still find ceiling support to stablize the offset bracket.

* * * * *